US006196194B1

(12) United States Patent
Mitchell

(10) Patent No.: US 6,196,194 B1
(45) Date of Patent: Mar. 6, 2001

(54) INJECTOR CLAMP

(75) Inventor: Scott Mitchell, Shropshire (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 09/306,746

(22) Filed: May 7, 1999

(30) Foreign Application Priority Data

May 9, 1998 (GB) ..... 9809867

(51) Int. Cl.[7] ..... F02M 55/02
(52) U.S. Cl. ..... 123/470; 123/509
(58) Field of Search ..... 123/470, 509, 123/472, 469, 468, 446

(56) References Cited

U.S. PATENT DOCUMENTS

| | | | | |
|---|---|---|---|---|
| 4,206,725 | * | 6/1980 | Jenkel et al | 123/470 |
| 4,246,877 | | 1/1981 | Kennedy | 123/470 |
| 5,499,612 | | 3/1996 | Haughney et al. | 123/470 |
| 5,566,658 | * | 10/1996 | Edwards et al. | 123/470 |
| 5,713,323 | * | 2/1998 | Walsh et al. | 123/184.42 |
| 5,730,101 | * | 3/1998 | Aupperle | 123/321 |
| 5,765,534 | * | 6/1998 | Brown et al. | 123/470 |
| 5,794,595 | * | 8/1998 | Berger et al. | 123/470 |
| 5,803,034 | * | 9/1998 | Gruner et al. | 123/90.38 |
| 5,806,494 | * | 9/1998 | Glassey | 123/456 |
| 6,026,786 | * | 2/2000 | Groff et al. | 123/501 |

FOREIGN PATENT DOCUMENTS

| | | |
|---|---|---|
| 0 320 160 | 6/1989 | (EP) . |
| 0 821 157 | 1/1998 | (EP) . |
| 2153908 | 8/1985 | (GB) . |
| 2213197 | 8/1989 | (GB) . |
| 2302136 | 1/1997 | (GB) . |

* cited by examiner

*Primary Examiner*—Carl S. Miller
(74) *Attorney, Agent, or Firm*—Alan J. Hickman

(57) ABSTRACT

The invention is a clamp for clamping a fuel injector in place on internal combustion engine which clamp has a first end adapted to engage a fuel injector body, a clamping force receiving portion and a fulcrum portion preferably located therebetween. The fulcrum portion is adapted in use to engage a fulcrum point on the engine in rolling contact. The invention also describes an internal combustion engine structure provided with a fuel injector clamped in place in the engine by means of the above described clamp and a method of use therefor.

15 Claims, 1 Drawing Sheet

INJECTOR CLAMP

BACKGROUND OF THE INVENTION

1. Field of the Invention

The present invention relates to apparatus and method for clamping a fuel injector in place on an internal combustion engine and an engine including such apparatus.

A clamp for an internal combustion engine injector must securely retain the injector against the forces generated within the engine cylinder and the clamping means must be readily accessible for installation and removal of the injector.

The technical and commercial advantages associated with minimising engine envelope size and the increasing fitment of multi-camshaft and multi-valve systems have reduced the available space for fitting a clamp retaining means closely adjacent to the injector, this being particularly the case in engines fitted with relatively large injectors as exampled by hydraulically or mechanically actuated and electronically controlled unit injectors. This provides an incentive for fitting clamp retaining means away from the injector if possible.

A further problem can arise if the injector clamping counterload is directed into an area of the engine located near the injector insertion point in the cylinder head. For example, any threaded holes provided for clamp retaining fasteners which are located adjacent to the injector may weaken a critical part of the cylinder head or may break through into an injector coolant jacket and thus require sealing against leakage. In these circumstances, it is again advantageous if the injector clamping counterload is located away from this critical area.

Further, injector removal and refitment may be required during engine servicing and it is therefore beneficial to minimise impedance to access and the time required for injector removal and refitment. In the prior art, the operations of fitting or removing a unit injector have generally required the complete removal and replacement of one or more threaded fasteners and hence, particularly in an engine with a high number of injectors, these operations are undesirably time consuming.

2. Description of the Related Art

An example of prior art means for clamping hydraulically actuated, electronically controlled, unit injectors may be seen in U.S. Pat. No. 5,499,612. Clamping means for other types of injectors may be seen in GB 2213197, U.S. Pat. Nos. 4,206,725 and 4,246,877.

OBJECTS AND SUMMARY OF THE INVENTION

It is an object or the present invention to provide an apparatus and a method for securely clamping an injector in an internal combustion engine whereby the means for retention of the clamp to the engine may be located distant from crowded and potentially critical loadbearing areas in the immediate vicinity of the injector.

It is a further object of the invention to provide an injector clamping apparatus and method which give relative ease of access to the injector so as to furnish a means for relatively rapid removal and refitment of an injector in a built engine.

According to one aspect of the invention, clamping means for clamping a fuel injector in place on an engine comprises a clamp adapted to engage clamp support means on an engine having a first end adapted to engage an injector body, a clamping force receiving portion, and a fulcrum portion wherein the upper surface of the clamp is adapted in use to engage a fulcrum point on the engine in rolling contact, and clamp force applying means that engages the clamp at the force receiving portion and co-operates with the fulcrum portion to apply a clamping load through the clamp to the injector body.

It has been mentioned that it is desirable that the means for retention of the clamp to the engine is located distant from crowded and potentially critical load bearing areas in the immediate vicinity of the injector. The fulcrum portion is preferably located between the first end and the clamping force receiving portion, which clamping force receiving portion is then preferably located towards the second end of the clamp. This assists in ensuring that the means by which the clamp is retained to the engine can be located at a greater distance from the injector.

The fulcrum portion preferably comprises a segmentally cylindrical portion on the upper surface of the clamp.

The first end of the clamp preferably engages the injector body in rolling contact. This assists in accurate axial transmission of the load. The clamp is conveniently bifurcated comprising a pair of arms which in use are in close co-operation with a pair of opposed flat surfaces on an injector body.

Conveniently each of the arms has an arcuate lug on its lower edge which engages a corresponding shoulder adjacent one of the pair of opposed flat surfaces on the injector so as to form points of rolling contact that lie in a plane through the axis of the injector so as to apply an axial clamping load to the injector.

According to a second aspect of the present invention there is provided an internal combustion engine structure provided with a fuel injector, said injector clamped in place on the engine by clamping means comprising a clamp engaging clamp support means on the engine and having a first end adapted to engage an injector body, a clamping force receiving portion, and a fulcrum portion, preferably comprising a curved upper surface in engagement with a fulcrum point on the engine at a point of rolling contact, and clamp force applying means that engages the clamp at the force receiving portion and co-operates with the fulcrum portion to apply a clamping load through the clamp to the injector body.

Again the fulcrum portion is preferably located between the first end and the clamping force receiving portion. The clamping force receiving portion is preferably located towards the second end of the clamp. The first end of the clamp preferably engages the injector body in rolling contact and is conveniently bifurcated comprising a pair of arms which in use are in close co-operation with a pair of opposed flat surfaces on an injector body and each of which has an arcuate lug on its lower edge which engages a corresponding shoulder adjacent one of the pair of opposed flat surfaces on the injector so as to form points of rolling contact that lie in a plane through the axis of the injector so as to apply an axial clamping load to the injector.

This aspect of the invention offers particular advantages in relation to hydraulically actuated electronically controlled unit injector (HEUI) systems where the engines are fitted with relatively large injectors which have the effect of limiting the available space for fitting any clamp closely adjacent to the injector, since clamp means in accordance with the present invention can be relatively remotely fixed.

Such (HEUI) systems utilise fluid supply means such as a high pressure pump to transmit actuating fluid to the injector typically via a supply manifold where it is stored in readiness for actuating the injector under electronic control.

A preferred actuating fluid is engine lubricating oil. Conveniently oil drain means are provided to return the oil to the engine sump.

In a particularly preferred embodiment of an (HEUI) injected engine in accordance with the invention the engine structure is provided with an actuating fluid supply system comprising a fluid supply manifold defining an internal fluid reservoir and means for communicating actuating fluid from the reservoir to an injector, said fluid supply system being engaged in place on the engine in such configuration that a lower surface of the manifold provides the fulcrum point to engage the fulcrum portion of the clamp to provide a point of rolling contact.

Such an arrangement keeps the manifold out of the way of the clamp retaining means facilitating easy removal and insertion of the clamp. In addition because of the location of the manifold a relatively short fluid outlet channel is provided which minimises leaks and pressure drop as fluid is communicated from the fluid reservoir to the injector on actuation.

Preferably the manifold is adapted to provide a planar surface at the fulcrum point of engagement with the curved upper surface of the clamp.

Preferably the engine structure comprises a plurality of piston cylinders each of said cylinders provided with a fuel injector wherein a fuel supply manifold is provided comprising a plurality of outlet channels, each outlet channel communicating actuating fluid to an associated injector.

According to a third aspect of the present invention, a method of clamping a fuel injector in place on an engine comprises locating clamp support means on an internal combustion engine provided with a fuel injector, providing a clamp having a first end adapted to engage an injector body, a clamping force receiving portion, and a fulcrum portion, engaging the clamp to the clamp support means in such orientation that the first end of the clamp engages the injector body, and the fulcrum portion engages a fulcrum point on the engine enrolling contact, and applying a force to the clamp force receiving portion which force acts through the fulcrum portion to apply a clamping load through the clamp to the injector body.

BRIEF DESCRIPTION OF THE DRAWINGS

By way of example, the invention will be described with reference to the accompanying drawings of which.

DESCRIPTION OF THE PREFERRED EMBODIMENTS

Figure 1:
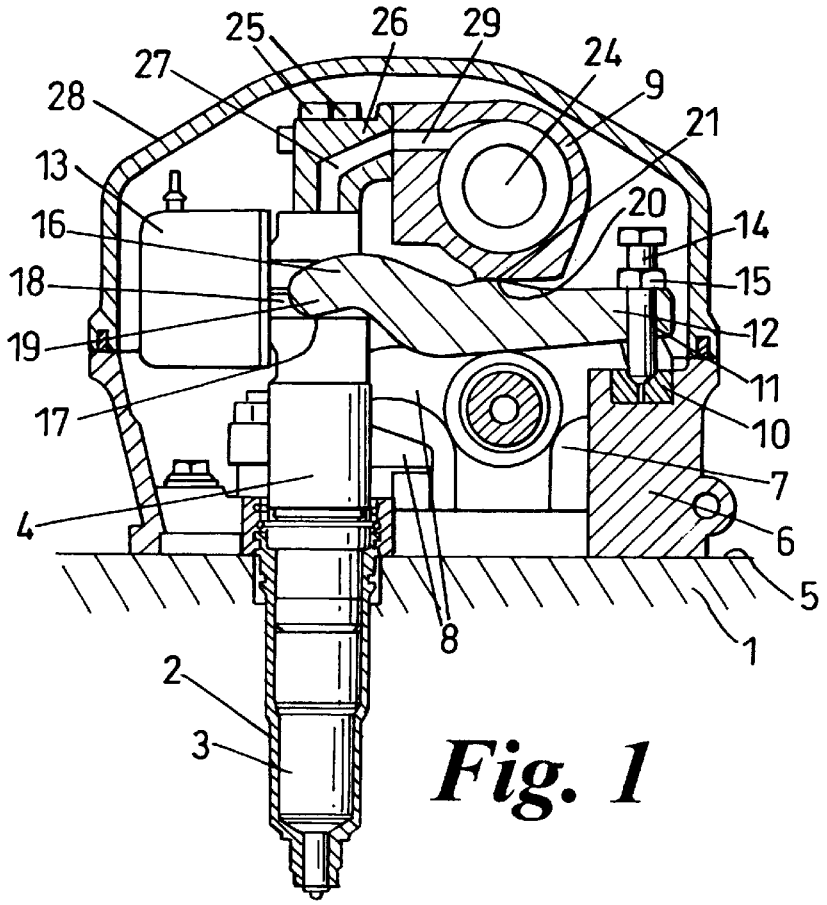
FIG. 1 is a cross-sectional view through the apparatus of the invention as fitted to an engine including a hydraulically actuated, electronically controlled, unit injector.

Referring to the drawings, FIG. 1 shows part of an engine cylinder head 1 prepared with a receiving hole 2 for the location of a nozzle end 3 of an injector 4 of the type used in a hydraulically actuated, electronically controlled, unit injector (HEUI) system.

Mounted to an upper face 5 of the cylinder head 1 is a rocker box 6 defining a volume 7 within which is located one or more conventional gas exchange valve mechanisms 8 (of which only a part is shown). An injector actuating fluid rail 9 defining a fluid reservoir 24 and having an outlet port 29 is located above the gas exchange valve mechanisms.

A thrust button 10 having a recess is fitted into a wall of the rocker box 6 in approximate lateral alignment with the injector receiving hole 2 in the cylinder head. The injector, complete with an electronic control valve 13, is inserted into the receiving hole.

Figure 2:
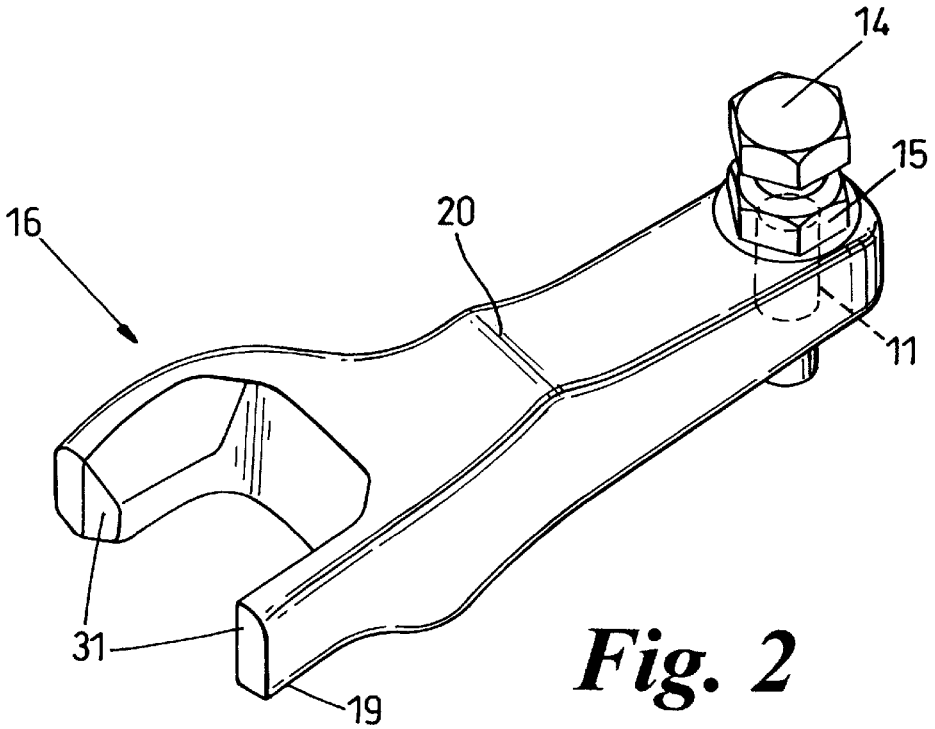
FIG. 2 is an isometric view of the injector clamp shown in FIG. 1.

An injector clamp 12, which may also be seen in FIG. 2, has a first end in the form of a fork having a pair of arms 31 and a second end including a threaded hole. The clamp is prepared by the loose fitment of an adjuster screw 14, to which has first been fitted a locknut 15, into the threaded hole 11. The clamp 12 is then slidingly positioned so that each arm of the first end 16 lies against one of an opposing pair of recessed flat surfaces 18 provided in the upper part of the injector body, so that an arcuate lug 19 sits upon a clamping shoulder 17 of the injector and the adjuster screw carried by the second end seats in the recess in the thrust button.

The adjuster screw 14 is screwed through the second end of the injector clamp in a direction which will bring a promontory 20 on an upper face of the clamp into light contact with a pad 21 on an underside of the fluid rail 9. From this point, the promontory will act as a fulcrum so that further tightening of the adjusting screw will apply a clamping load to the shoulder of the injector.

The adjusting screw may be tightened further either by a specified number of turns or to a specified torque which has been calculated to apply a predetermined load to the injector shoulder 17 in order to securely retain the injector in the cylinder head. The locknut is then tightened to retain the rotational position of the adjusting screw. A typical tightening torque for the adjusting screw is 36 Nm.

Following the fitment and adjustment of the injector clamp 12, a transfer block 26 providing an actuating fluid outlet channel 27 is mechanically and fluidly connected between the fluid rail outlet 29 and the injector 4 and a cover 28 may then be affixed to the rocker box 6 in the conventional manner.

When the injector is subsequently to be removed, for routine servicing or other reason, it is a simple matter to remove the rocker box cover 28 and the transfer block 27 and then to slacken the adjuster screw locknut and unscrew the adjuster screw 14 just sufficiently to allow the end to be disengaged from the recess in the thrust button 10. The clamp arm 12 may then be slidingly removed and the injector lifted out of the cylinder head.

The procedure for refitment of the injector in service conditions is identical to the fitting procedure described above.

The above given example relates to an engine fitted with an injection system of the HEUI type but the present invention is not limited to engines of this type. For example, an engine fitted with a pump-line-nozzle system could use an extension of a rocker shaft bracket or camshaft carrier bracket as a fulcrum point for the injector clamp.

What is claimed is:

1. A clamping means for clamping a fuel injector in place on an engine, comprising:

a clamp adapted to engage a clamp support means on an engine, said clamp having a first end adapted to engage an injector body, a clamping force receiving portion, and a fulcrum portion located between the first end and the clamping force receiving portion, said fulcrum portion being located on an upper surface of the clamp and being adapted in use to engage a fulcrum point on the engine in rolling contact; and a clamp force applying means being engageable with the clamp at the clamping force receiving portion and co-operating with the fulcrum portion to apply a clamping load through the clamp to the injector body.

2. Clamping means as claimed in claim 1 wherein the clamping force receiving portion is located towards the second end of the clamp.

3. A clamping means for clamping a fuel injector in place on an engine, comprising:

a clamp adapted to engage a clamp support means on an engine, said clamp having a first end adapted to engage an injector body, a clamping force receiving portion, and a fulcrum portion, said fulcrum portion being located on an upper surface of the clamp and being adapted in use to engage a fulcrum point on the engine in rolling contact, the fulcrum portion includes a segmentally cylindrical portion on the upper surface of the clamp; and a clamp force applying means being engageable with the clamp at the clamping force receiving portion and co-operating with the fulcrum portion to apply a clamping load through the clamp to the injector body.

4. Clamping means as claimed in claim 1 wherein the first end of the clamp engages the injector body in rolling contact.

5. Clamping means as claimed in claim 1 wherein the clamp is bifurcated comprising a pair of arms which in use are in close co-operation with a pair of opposed flat surfaces on an injector body.

6. Clamping means as claimed in claim 5 wherein each of the arms has an arcuate lug on its lower edge which engages a corresponding shoulder adjacent one of the pair of opposed flat surfaces on the injector so as to form points of rolling contact that lie in a plane through the axis of the injector so as to apply an axial clamping load to the injector.

7. An internal combustion engine structure provided with a fuel injector, said fuel injector being clamped in place on the engine by a clamping means, comprising:

a clamp engaging a clamp support means on the engine, said clamp having a first end adapted to engage an injector body, a clamping force receiving portion and a fulcrum portion located between the first end and the clamping force receiving portion, said fulcrum portion being in engagement with a fulcrum point on the engine at a point of rolling contact; and a clamp force applying means being engageable with the clamp at the clamping force receiving portion and co-operating with the fulcrum portion to apply a clamping load through the clamp to the injector body.

8. An internal combustion engine structure as claimed in claim 7 wherein the fulcrum portion of the clamp comprises a curved upper surface.

9. An internal combustion engine structure as claimed in claim 7 wherein the clamping force receiving portion is located towards the second end of the clamp.

10. An internal combustion engine structure as claimed in claim 7 wherein the first end of the clamp engages the injector body in rolling contact.

11. An internal combustion engine structure as claimed in claim 10 wherein the first end of the clamp is bifurcated comprising a pair of arms which in use are in close co-operation with a pair of opposed flat surfaces on an injector body and each of which has an arcuate lug on its lower edge which engages a corresponding shoulder adjacent one of the pair of opposed flat surfaces on the injector so as to form points of rolling contact that lie in a plane through the axis of the injector so as to apply an axial clamping load to the injector.

12. An internal combustion engine structure provided with a fuel injector, said fuel injector being clamped in place on the engine by a clamping means, comprising:

a clamp engaging a clamp support means on the engine, said clamp having a first end adapted to engage an injector body, a clamping force receiving portion and a fulcrum portion in engagement with a fulcrum point on the engine at a point of rolling contact;

a clamp force applying means being engageable with the clamp at the clamping force receiving portion and co-operating with the fulcrum portion to apply a clamping load through the clamp to the injector body; and an actuating fluid supply system including:

a fluid supply manifold defining an internal fluid reservoir and means for communicating actuating fluid from the reservoir to a fuel injector, said actuating fluid supply system being engaged in place on the engine in such configuration that a lower surface of the manifold provides the fulcrum point to engage the fulcrum portion of the clamp to provide a point of rolling contact.

13. An internal combustion engine structure as claimed in claim 12 wherein the manifold is adapted to provide a planar surface at the fulcrum point of engagement with the curved upper surface of the clamp.

14. An internal combustion engine structure as claimed in claim 12 comprising a plurality of piston cylinders each of said cylinders provided with a fuel injector wherein a fuel supply manifold is provided comprising a plurality of outlet channels, each outlet channel communicating actuating fluid to an associated injector.

15. A method of clamping a fuel injector in place on an engine, comprising:

locating a clamp support means on an internal combustion engine provided with a fuel injector;

providing a clamp having a first end adapted to engage an injector body, a clamping force receiving portion, and a fulcrum portion located between the first end and the clamping force receiving portion;

engaging the clamp to the clamp support means in such orientation that the first end of the clamp engages the injector body, and the fulcrum portion engages the fulcrum point on the engine in rolling contact; and applying a force to the clamp force receiving portion which force acts through the fulcrum portion to apply a clamping load through the clamp to the injector body.

* * * * *